United States Patent [19]

Hawkins et al.

[11] Patent Number: 4,896,782

[45] Date of Patent: Jan. 30, 1990

[54] CLOSURE WITH INSERT FOR ENHANCED SEALING

[75] Inventors: H. Gene Hawkins; Randall K. Julian; Gary V. Montgomery, all of Evansville, Ind.

[73] Assignee: Sunbeam Plastics Corporation, Evansville, Ind.

[21] Appl. No.: 309,175

[22] Filed: Feb. 13, 1989

[51] Int. Cl.[4] ..... B65D 41/28

[52] U.S. Cl. ..... 215/329; 215/352; 215/276

[58] Field of Search ..... 215/352, 329, 343, 276

[56] References Cited

U.S. PATENT DOCUMENTS

| | | | |
|---|---|---|---|
| 666,139 | 1/1901 | Hay | 215/276 |
| 2,144,287 | 1/1939 | Enkur | 215/276 |
| 2,467,979 | 4/1949 | Krueger | 215/352 X |
| 3,411,649 | 11/1968 | Mumford | 215/40 |
| 3,433,380 | 3/1969 | Kawchitch | 215/343 X |
| 3,443,711 | 5/1969 | Olson | 215/7 |
| 3,491,908 | 1/1970 | Beimers | 215/276 |
| 3,633,781 | 1/1972 | Zapata | 215/343 X |
| 3,677,430 | 7/1972 | Yates, Jr. | 215/352 X |
| 3,930,589 | 1/1976 | Koontz | 215/352 |
| 4,094,460 | 6/1978 | Scanga | 215/352 X |
| 4,256,234 | 3/1981 | Mori et al. | 215/343 |
| 4,366,913 | 1/1983 | Winchell et al. | 215/329 |
| 4,813,561 | 3/1989 | Ochs | 215/252 |

FOREIGN PATENT DOCUMENTS

| | | | |
|---|---|---|---|
| 488194 | 3/1975 | Australia . | |
| 1068346 | 6/1954 | France . | |
| 128796 | 7/1950 | Sweden | 215/352 |

*Primary Examiner*—Donald F. Norton

*Attorney, Agent, or Firm*—Gifford, Groh, Sprinkle, Patmore and Anderson

[57] ABSTRACT

A closure having an insert which acts as a barrier over a container neck lip to selectively shield the product being packaged. An elastic sealing member which can be in the form of an O-ring is compressed between the insert and the container neck lip by a threaded cap of the container.

24 Claims, 2 Drawing Sheets

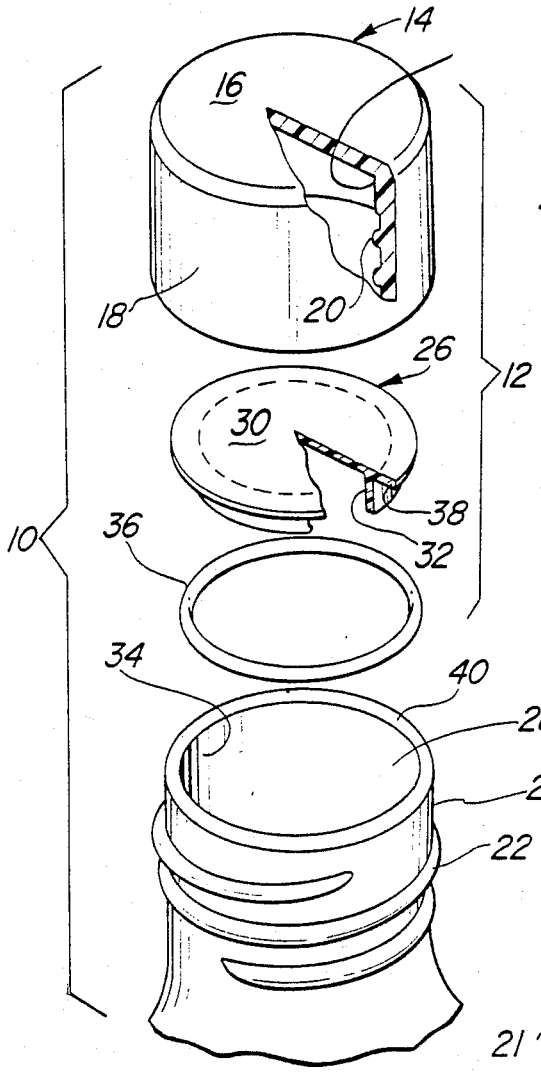
Fig-1
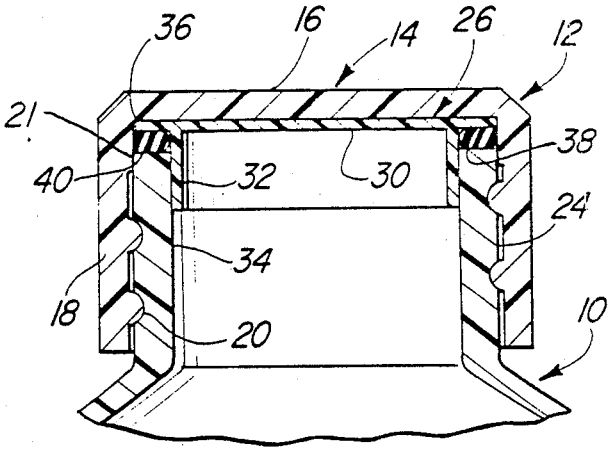
Fig-2
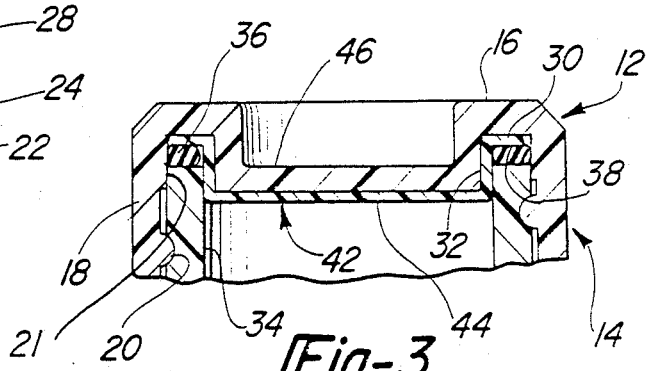
Fig-3
Fig-4
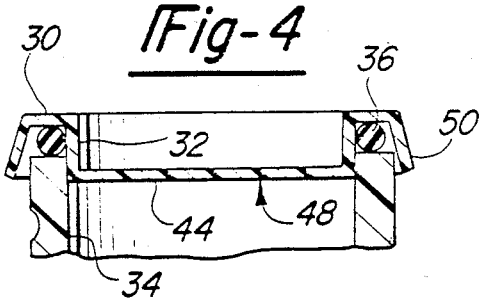
Fig-5
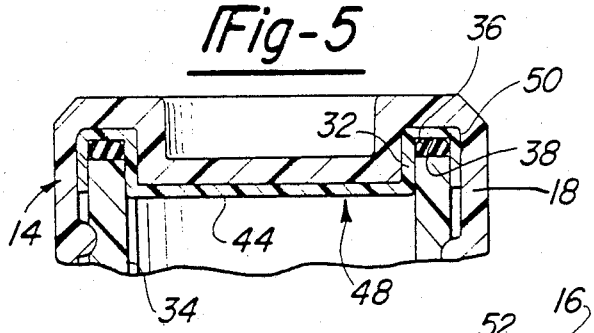
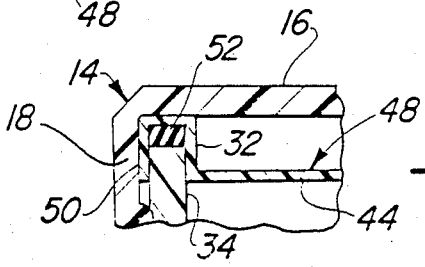
Fig-6

CLOSURE WITH INSERT FOR ENHANCED SEALING

This invention relates to closures that are designed to effect a hermetic seal when attached to a container neck, and, more particularly to closures that provide a hermetic seal and a selective barrier for the product in the container to which the closure is attached.

Conventionally a closure in the form of a threaded cap utilizes a gasket to form the seal between the cap and container neck. These gaskets are often paper board to provide a degree of compression when the cap is threaded onto the container neck, and the paperboard may laminated with other materials such as a wax material, a thermoplastic film or a metal foil or a combination of these materials to provide waterproofing, or adhesion to the inside of the cap top. Often times this type of gasket or seal is cemented or heat bonded to the lip of the container neck to provide a hermetic seal.

When the container and closure must be subjected to elevated temperatures such as in the sterilization of the product being packaged, this type of gasket seal is unsatisfactory. Attempts to maintain a seal at elevated temperatures has resulted in various designs, one of which includes the elimination of a gasket entirely and substituting a seal utilizing multiple sealing fins or rings which are integrally molded into the cap top. This and other types of seal designs have produced less than a satisfactory solution to maintaining a high temperature seal.

A solution to the problem of maintaining a seal during sterilization of the container-closure package has been obtained with the closure set forth in the copending patent application, Ser. No. 07/240,630 filed Sept. 6, 1988, now U.S. Pat. No. 4,844,273, in the name of Hawkins, one of the coinventors of the present application. In this closure, a threaded cap has an inner plug which cooperates with an outer bead to capture the container neck lip to maintain an elastic sealing member, such as an O-ring or poured-in plastisol material, in compression between the container neck lip and cap top to sustain a hermetic seal.

In some circumstances the closure must provide special protection for the contents of the container which would not be provided by an otherwise satisfactory seal. For example, in the case of certain food products and medications, even the slightest oxidation causes objectionable deterioration of product quality. In some instances a satisfactory oxygen barrier can be produced by a laminated foil seal which is heat sealed to the container neck lip; although the secondary heat sealing operation can greatly add to the packaging expense. Under higher temperature environments such a solution is entirely unsatisfactory. Making the entire closure of an oxygen impermeable material may solve the oxidation problem but at a considerable expense, and in fact, the use of such a material greatly complicates the sealing problem with less thread definition and the like due to the change in properties over the normally used container and closure polymers such as polypropylene.

The present invention is directed to the solution of the foregoing special sealing problems including those generated when the closure/container package is subjected to higher temperatures.

In one aspect, the present invention can be considered to be an improvement over the previously mentioned Hawkins patent application in providing a selective barrier to a high temperature stable closure. In other aspects, the present invention can be considered to be a new or alternative closure providing a barrier, such as an oxygen barrier at any normally used temperature, and providing a high temperature stable closure per se.

The closure of this invention can utilize a conventional cap having a top and an annular skirt depending from the periphery of the top having internal threads for engaging external threads on the container neck. A preformed barrier or insert having a top and depending plug dimensioned for an interference fit with the container neck is designed to fit within the cap. A third element of the closure combination is an elastic sealing member which is dimensioned to engage the container neck lip and the top of the insert to be compressed therebetween so that the seal is established and maintained between the closure and the container neck by the preformed insert being held in position relative to the container neck by the plug. A rigid structure is maintained on both sides of the container neck lip by the internal cap wall or thread diameter and the insert plug. The elastic sealing member is compressed between the insert top and the container lip to sustain a hermetic seal even during distortion which takes place in an elevated temperature environment. The elastic sealing member can take the form of an O-ring or a flowed-in gasket material. When the cap is threaded onto the container neck, the top of the cap engages the top of the insert to maintain the sealing member compressed between the insert and the lip of the container neck. If the closure-container package is to be subjected to high temperatures, such as in sterilization, the cap is normally threaded onto the container neck before heat processing. In other instances, the elastic sealing member can be compressed between the insert top and the container neck lip by fixturing in the heat retort processing unit, and the cap can be threaded onto the container neck after such processing.

Where the closure must provide an oxygen barrier, the insert can be made from a material having such a property; thus, the desirable qualities of the cap and insert are separately maintained while reducing the cost of making the cap with the barrier material.

The preformed insert can be a molded plastic or a laminated or layered plastic material preformed by compression molding or a similar process. For higher temperature applications, the insert can be a preformed metal insert. In this case the top can have an annular sealing area and an open center to reduce the amount of material used in the cap. In the case of a metal insert, the top of the insert can be formed with a raised central shoulder which snaps into the open central portion of the cap top for retention.

Other modifications of the insert and cap configuration will be apparent from the following description and appended claims setting forth the elements of the invention.

The preferred embodiments of the invention are illustrated in the drawing in which:

FIG. 1 is an exploded perspective view of the closure including an O-ring used as the elastic sealing member showing its relationship to the container neck lip and an insert which acts as a barrier as they are fitted within the threaded closure cap;

FIG. 2 is a sectional elevational view showing the closure in place on the container neck and displaying the sealing coaction of the invention which is accomplished with the insert being positioned by its depending plug, the elastic sealing element being compressed between the top of the insert and the container neck lip, and a rigid structure being maintained on both sides of the container neck lip by the insert plug and inside diameter of the closure cap;

FIG. 3 is a partial cross-sectional view similar to FIG. 2 showing a different configuration for the insert and the cap top which can be more suitable for some forms of the preformed insert as for example in a laminated or layered insert material;

FIG. 4 is a partial cross-sectional view similar to FIG. 2 showing a form of the insert as it is applied with an elastic sealing element in the form of an O-ring to a container neck and showing a variation in the insert structure which includes a peripheral skirt depending from the insert top with the skirt diverging outwardly so that the O-ring is confined between the insert skirt and plug as it will be compressed in use; and the insert will be retained in the cap skirt as the insert skirt is flexed inwardly by the cap skirt.

FIG. 5 is a partial cross-sectional view similar to FIGS. 2 and 3 showing the insert of FIG. 4 and the O-ring as it is compressed by threading the cap onto the container neck and showing that the insert skirt as it has been deflected inwardly by the cap skirt for retention within the cap skirt prior to application to the container neck;

FIG. 6 is a fragmentary cross-sectional view similar to FIGS. 2, 3 and 5 showing the insert with an outer skirt as in FIGS. 4 and 5 and the elastic sealing member as a poured-in plastisol material, the cap top being shown as a flat planar top and not conformed with the insert plug;

Figure 7:
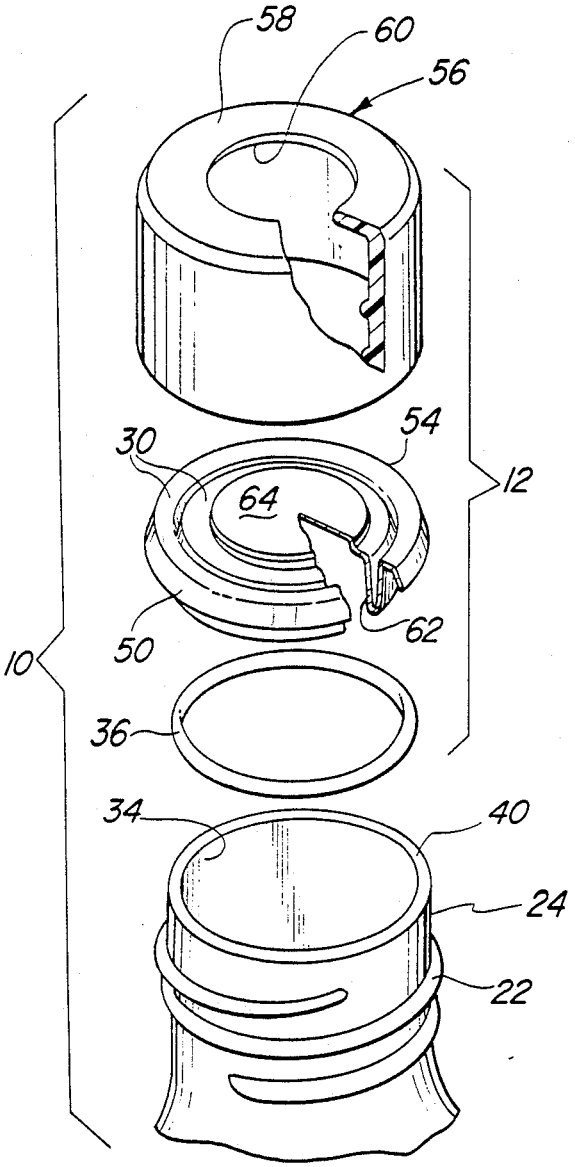
FIG. 7 is an exploded perspective view of another embodiment of the closure of this invention as it is applied to the container neck, the insert being shown as a preformed metal insert and the elastic sealing member as an O-ring.

FIG. 1 shows a closure/container package 10 which incorporates the three element closure 12 of the present invention. Closure 12 includes a standard threaded cap 14 having a planar top 16 and a depending skirt 18 with internal threads 20 which engage complementary threads 22 on container neck 24. Inwardly directed shoulder 21 on cap skirt 18 above threads 20 is provided to engage the outside diameter of the container neck lip. The second element of closure 12 is a preformed insert 26 which serves as a barrier over container neck opening 28. Insert 26 is an injected molded plastic formed with a planar top 30 and a depending plug 32 which engages the internal neck surface 34 with an interference fit to firmly position and hold the insert relative to container neck 24. The third element of closure 12 is an elastic sealing element shown as O-ring 36. O-ring 36 is normally slipped over insert plug 32 and held in place by friction. Insert 26 can be retained in cap 14 by any suitable means such as a friction fit of the insert top with the cap skirt for shipment of the three element closure 12 as a unit.

When the closure 12 is threaded onto the container neck 24, the insert plug firmly positions the insert 26 with respect to the container neck 24. Planar cap top 16 presses against the planar top 30 of insert 26 to compress the O-ring 36 between the annular sealing area 38 of the insert and the container neck lip 40. A rigid structure is maintained on both sides of the container neck lip 40 by the internal diameter of the cap at shoulder 21 acting against the outside diameter of the lip 40 and the insert plug 32 acting against the inside diameter of the lip 40. In some instances, the thread 20 can provide the rigid outside diameter contact, particularly where the thread extends to the end of the container neck.

When the product being packaged is to be sterilized, such as in the case of certain food and medicinal products, the seal integrity will be maintained by this rigid structure. While the insert plug will normally be dimensioned to have an interference fit with the inside of the container neck, such interference can be caused by the inward pressure of the cap skirt against the container neck lip. The seal integrity will be maintained even though at sterilization temperatures above 250° F. both the container and the cap have little more structural integrity than that of jelly. The insert 26 can be made with a heat stable material such as a fiberglass impregnated plastic to add to the structural integrity at the sterilization temperatures and to act as a heat barrier protecting the product. The material of the insert 26 can also be selected to have desired physical properties such as to present an oxygen barrier to protect the product not only at elevated temperatures but at normally encountered temperatures. Suitable oxygen barrier material for the insert would be nylon or a copolymer of polypropylene and ethylene vinyl alcohol (EVOH).

The configuration of insert 42 in FIG. 3 allows preforming by various pressure molding techniques as well as injection molding so that the insert may be made from a layered or laminated plastic material or it may be a pressure formed metal for maximum stability under sterilization temperatures. The insert plug can depend from the inner periphery of the annular sealing area 38 and have a closing disc surface 44.

Insert 48 of FIGS. 4–6 is formed with a closed end plug as insert 42 of FIG. 3 but with an additional peripheral skirt 50 which may be flared or made to diverge outwardly as shown in FIG. 4 to provide a spring retention for the bitting in of its lower edge when inserted into the closure top 14 as shown in FIGS. 5 and 6. The sealing member or O-ring 36 is confined between the insert skirt and plug as it is compressed between the insert top and container neck lip. Additional rigidity is added to insert 48 by peripheral skirt 50 which also further guarantees seal integrity particularly under sterilization temperatures by its peripheral contact with the exterior of the container neck lip. The cap skirt 18 firmly holds the peripheral skirt 50 of insert 48 in position. The sealing member 52 as shown in FIG. 6 is a poured-in plastisol material.

The closure 12 of container/closure package 10 as shown in FIG. 7 is a three element closure like that of FIG. 1, but is designed to accommodate the preformed metal insert 54. Cap 56 is formed with an annular top 58 having a central open area 60 saving weight and cost in the cap. Insert plug 62 is a folded over double wall structure which is easily formed to provide a springing interference fit with internal container neck surface 34. The insert top 30 can be formed with a raised central shoulder 64 which can snap into opening 60 as shown at 66 in FIG. 8. An insert skirt is provided so that O-ring 36 is confined between the skirt and plug 62 at least during application of the closure to the container neck. Normally the O-ring would be retained on the insert by a friction fit with the insert plug in a manner shown in FIG. 4 or in contact with the insert skirt. Alternatively or additionally, the insert skirt may be flared outwardly so that as it is inserted into a cap skirt it will take the position shown at 50' in FIG. 9 being held within the cap skirt by spring action. With this type of retention, the raised insert shoulder 64 can be omitted as shown in FIG. 9. Likewise, a poured-in plastisol material may be substituted for the O-ring as the elastic sealing member as shown in FIG. 9.

Figure 8:
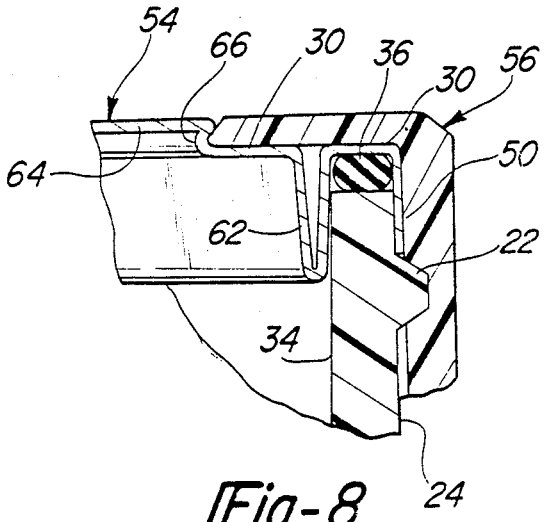
FIG. 8 is a partial cross-sectional elevational view of the closure of FIG. 8 with the cap being threaded onto the container neck to compress the O-ring between the metal insert and the container neck lip and showing a raised central shoulder of the insert snapped into an open central portion of the cap top.
Figure 9:
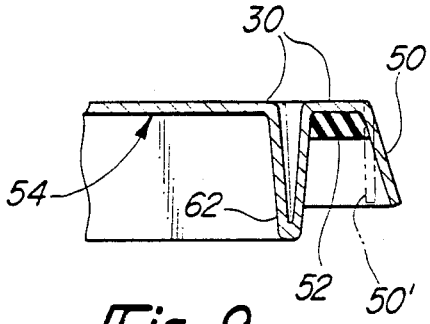
FIG. 9 is a partial cross-sectional view of a performed metal insert suitable for use with the closures of FIGS. 8 and 9 with an outer skirt diverging outwardly so that when it is inserted into the cap, the insert will be retained by the spring action of the insert skirt against the cap skirt, and the elastic sealing member being shown as a poured-in plastisol.
Figure 10:
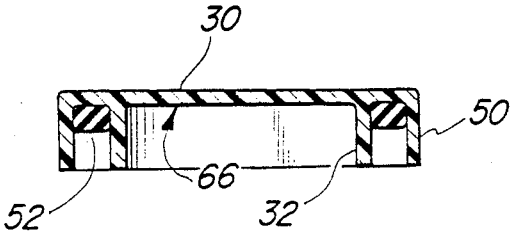
FIG. 10 shows another form of the insert which can be injection molded with its central plug and outer skirt and a planar top, the elastic sealing member being shown as a poured-in plastisol, the insert being useable with the full flat top caps of FIGS. 1 and 2, or open center tops of FIGS. 7, 8 and 9.

Insert 66 of FIG. 10 is a configuration similar to the metal insert of FIGS. 7–9 which can be injection molded as a substitute. Also, the O-ring can be replaced by a poured-in plastisol material 52 in the same manner as shown in FIG. 9.

The embodiments of the invention in which an exclusive property or privilege is claimed are defined as follows:

1. A closure particularly adapted to maintain a sealing relationship with the lip of a container neck, comprising:

a cap having a top and an annular skirt depending from the periphery of said top having internal threads for engaging external threads on said container neck;

a preformed insert having a top and a depending plug dimensioned for an interference fit with said container neck; and an elastic sealing member dimensioned to engage said container neck lip and the top of said insert and to be compressed therebetween;

whereby a seal is established and maintained between said closure and said container neck by the preformed insert being held in position relative to said container neck by said plug, a rigid structure is maintained on both sides of the container neck lip by said insert plug and the cap skirt, and said elastic sealing member being compressed between said insert top and container neck lip sustaining a hermetic seal even during distortion that takes place in an elevated temperature environment.

2. The closure according to claim 1 wherein when said cap is threaded onto said container neck, the top of said cap engages the top of said insert to maintain said sealing member compressed between the insert and the lip of the container neck, while the container neck lip is secured between the insert plug and the internal neck threads of the cap.

3. The closure according to claim 1 wherein said elastic sealing member is an O-ring.

4. The closure according to claim 1 wherein said plastic sealing member is flowed-in gasket material.

5. The closure according to claim 1 wherein said insert is made with a plastic material.

6. The closure according to claim 5 wherein said material acts as an oxygen barrier.

7. The closure according to claim 5 wherein said material is a heat stable material including impregnated fiberglass.

8. The closure according to claim 1 wherein said insert is a preformed metal.

9. The closure according to claim 1 wherein said insert top has a planar surface and said cap top engages said insert top at least from adjacent said cap skirt to a portion overlying said sealing member.

10. The closure according to claim 9 wherein said cap top has a planar surface which engages the planar surface of said insert top.

11. The closure according to claim 9 wherein said insert has a skirt depending from the periphery of said planar top surface for engagement with said container neck and said sealing member is confined between said insert skirt and plug as it is compressed between said insert top and container neck lip.

12. The closure according to claim 1 wherein said insert top presents an annular surface between said cap top and sealing member, and said plug depends from the inner periphery of said annular surface with a closing disc surface at the terminal end of said plug.

13. The closure according to claim 12 wherein said cap top has an annular planar surface with said cap skirt depending from the outer periphery thereof and a closed shoulder depends from the inner periphery of said annular surface to conform with the closing disc surface at the terminal end of said insert plug.

14. The closure according to claim 13 wherein said annular insert surface has a skirt depending from the outer periphery thereof for engagement with said container neck, and said sealing member is confined between said insert skirt and plug as it is compressed between said insert top and container neck lip.

15. The closure according to claim 1 wherein said cap top has an open central circular area.

16. The closure according to claim 15 wherein said insert is a molded plastic.

17. The closure according to claim 15 wherein said insert is a preformed metal.

18. The closure according to claim 17 wherein said insert top has a raised central shoulder which snaps into the open central portion of said top for retention therein.

19. The closure according to claim 18 wherein said insert plug is formed as a folded member, and said insert top has an annular surface overlying said sealing member and container neck lip with a skirt depending from the periphery thereof for engagement with said container neck and said cap skirt confining said sealing member between said insert skirt and plug as it is compressed between said insert top and container neck lip.

20. The closure according to claim 17 wherein said insert has a skirt depending from the periphery of its top for engagement with said container neck, and said sealing member is confined between said insert skirt and plug as it is compressed between said insert top and container neck lip.

21. The closure according to claim 20 wherein said insert skirt diverges outwardly from insert top so that the insert skirt coacts with said cap to retain said insert in said cap.

22. A closure particularly adapted to maintain a sealing relationship with a lip of a container neck comprising:

a cap having an annular top an open central circular area and a skirt depending from the outer periphery of said top having internal threads for engaging external threads on said container neck;

a preformed metal insert having a top and a depending plug dimensioned for an interference fit with said container neck; and an elastic sealing member dimensioned to engage said container neck lip and the top of said insert and to be compressed therebetween;

whereby a rigid structure is maintained on both sides of said container neck lip by said insert plug and said cap skirt, and as said cap is threaded onto said container neck, said annular cap top contacts said metal insert top to compress said elastic sealing member between said insert top and container neck lip to establish and sustain a hermetic seal.

23. The closure according to claim 22 wherein said insert top has a raised central shoulder portion which snaps into the open central portion of said cap top for retention therein.

24. The closure according to claim 23 wherein said insert has a skirt depending from the periphery of its top diverging outwardly to a free end which engages said cap skirt to retain said insert in said cap, and said sealing member is confined between said insert skirt and plug as it is compressed between said insert top and container neck lip.

* * * * *